US010665987B2

(12) United States Patent
Lötkemann et al.

(10) Patent No.: US 10,665,987 B2
(45) Date of Patent: May 26, 2020

(54) PLUG CONNECTOR WITH CIRCLIP ENGAGING BETWEEN A SOCKET HOUSING AND A SCREW ATTACHMENT

(71) Applicant: HARTING Electric GmbH & Co. KG, Espelkamp (DE)

(72) Inventors: Irina Lötkemann, Espelkamp (DE); Sebastian Griepenstroh, Lübbecke (DE); Florian Hackemeier, Rahden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/475,467

(22) PCT Filed: Jan. 15, 2018

(86) PCT No.: PCT/DE2018/100022
§ 371 (c)(1),
(2) Date: Jul. 2, 2019

(87) PCT Pub. No.: WO2018/141326
PCT Pub. Date: Aug. 9, 2018

(65) Prior Publication Data

US 2019/0348798 A1 Nov. 14, 2019

(30) Foreign Application Priority Data

Jan. 31, 2017 (DE) ..... 10 2017 101 870

(51) Int. Cl.
*H01R 13/622* (2006.01)
*H01R 13/508* (2006.01)
(Continued)

(52) U.S. Cl.
CPC ..... *H01R 13/622* (2013.01); *H01R 13/508* (2013.01); *H01R 13/5202* (2013.01);
(Continued)

(58) Field of Classification Search
CPC ..... H01R 13/622; H01R 13/639; H01R 13/5219; H01R 13/625; H01R 9/0521; H01R 9/0524; H01R 13/6277
(Continued)

(56) References Cited

U.S. PATENT DOCUMENTS 6,086,400 A * 7/2000 Fowler ..... H01R 13/622 439/320
2014/0342605 A1* 11/2014 Burris ..... H01R 13/622 439/578
2016/0043503 A1 2/2016 Garske

FOREIGN PATENT DOCUMENTS

CH 232218 A 5/1944
DE 822266 C 11/1951
(Continued)

*Primary Examiner* — Abdullah A Riyami
*Assistant Examiner* — Justin M Kratt
(74) *Attorney, Agent, or Firm* — Smartpat PLC

(57) ABSTRACT

A plug connector housing has a socket housing and a screw attachment. The socket housing has an outer surface of circular cross section with an encircling first groove formed therein. The screw attachment has an inner surface of circular cross section with an encircling second groove formed therein. The plug connector housing furthermore has a circlip which is arranged with its inner circumference in the first groove and with its outer circumference in the second groove in order to hold the screw attachment rotatably on the socket housing.

9 Claims, 4 Drawing Sheets

(51) Int. Cl.

| | |
|---|---|
| ***H01R 13/52*** | (2006.01) |
| ***H01R 13/639*** | (2006.01) |
| *H01R 9/05* | (2006.01) |
| *H01R 13/625* | (2006.01) |
| *H01R 13/627* | (2006.01) |

(52) U.S. Cl.
CPC ..... *H01R 13/639* (2013.01); *H01R 9/0521* (2013.01); *H01R 9/0524* (2013.01); *H01R 13/5219* (2013.01); *H01R 13/625* (2013.01); *H01R 13/6277* (2013.01)

(58) Field of Classification Search
USPC ..... 439/320, 307, 321
See application file for complete search history.

(56) References Cited

FOREIGN PATENT DOCUMENTS

| | | | |
|---|---|---|---|
| DE | 825566 | C | 12/1951 |
| DE | 10353886 | | 2/2005 |
| DE | 202013100979 | U1 | 3/2013 |
| DE | 202012101303 | U1 | 7/2013 |
| DE | 202013012011 | U1 | 2/2015 |
| GB | 2149235 | B | 7/1987 |

* cited by examiner

PLUG CONNECTOR WITH CIRCLIP ENGAGING BETWEEN A SOCKET HOUSING AND A SCREW ATTACHMENT

TECHNICAL FIELD

The disclosure generally relates to a plug connector housing, and more specifically to a plug connector housing suitable for screwing a plug connector to a mating plug in the plugged-in state in order to prevent the plug connection from being unintentionally separated.

BACKGROUND

In the prior art, such screw connections are known, for example, from publication DE 20 2013 100 979 U1. A circular plug connector having a socket housing is disclosed therein. This connector has a locking means which is formed as a screw attachment and is arranged on the socket housing on the plug side. On the inside of the locking means there is provided an internal thread by means of which the circular plug connector can be screwed onto the mating plug connector in order to mechanically lock the plug connection.

In this construction, the rotatable holding of the screw attachment on the socket housing is conventionally achieved via a plurality of individual locking projections made of plastics material, which are formed on the inner surface of the screw attachment. Assembly of the plug connector housing, that is to say pushing of the screw attachment onto the socket housing, requires corresponding deformability of the socket housing and/or of the screw attachment.

A disadvantage of this prior art is that this rotatable fixing of the screw attachment to the socket housing is not sufficiently stable for many applications. For example, it has been shown in practice that problems arise in particular as a result of a heavy cable attached to the socket housing. Transverse forces caused thereby can at worst even separate the screw attachment from the socket housing as a result of a corresponding lever action, in particular under the action of vibration and regular and/or occasional shocks, and thereby interrupt the electrical connection. Corresponding situations can occur, for example, in the field of the foodstuffs industry, on production lines or also in railway applications, if the mating plug is mounted with an external mounting housing on a wall.

The German Patent and Trademark Office searched the following prior art in the priority application relating to the present application: DE 20 2012 101 303 U1, CH 232 218 A, DE 82 55 66 B and DE 20 2013 100 979 U1.

SUMMARY

An object of the invention is to provide a structural form for a plug connector housing having a socket housing and a screw attachment held rotatably thereon, which avoids those problems and ensures high stability against tensile and lever forces in the plugged-in state.

This object is achieved by the subject-matter as claimed.

The plug connector housing has a socket housing and a screw attachment. The socket housing has an outer surface of circular cross-section with a circumferential first groove formed therein. The screw attachment has an inner surface of circular cross-section with a circumferential second groove formed therein. The plug connector housing further has a circlip which is arranged with its inner circumference in the first groove and with its outer circumference in the second groove in order to hold the screw attachment rotatably on the socket housing.

Advantageously, a force acting on the socket housing is transmitted via the circlip to the major part of the circumference of the screw attachment. Finally, the circlip can apply the counterforce to the expected permanent axial and/or transverse forces over a very large area. Said forces are thus distributed homogeneously over almost the entire circumference of the plug connector housing. The screw attachment is thus held stably on the socket housing even under considerable loads. As is demonstrated by simulations and corresponding empirical tests, this is the case even under the action of vibration and occasional and/or regularly occurring shocks.

An additional advantage is that the plug connector housing must be of a less elastic design compared to the construction known from the prior art, because assembly thereof takes place by means of a deformation of the circlip, that is to say does not require deformation of the housing components, namely of the socket housing and/or of the screw attachment. The socket housing and/or the screw attachment can thus be made of a harder material, for example of a harder plastics material, and/or have greater stiffness due to their shape, than is the case in the prior art. As a result of these measures too, they are better able to accommodate the forces that occur without disengaging from one another in an undesirable manner.

Advantageous embodiments of the invention are described in the dependent claims.

In an advantageous embodiment, the circlip is made of a spring-elastic material, in particular of spring-elastic steel, for example of spring-elastic stainless steel. In another embodiment, however, it can in principle also be made of a spring-elastic plastics material.

Advantageously, the circlip has a circular basic shape and is open at one point and thus elastically deformable, in particular expandable and compressible, in the radial direction.

Furthermore, it is advantageous if both the first groove and the second groove and also the circlip have a rectangular profile. In particular, it is advantageous if the width of the first groove, of the second groove and of the circlip correspond to one another. The circlip is thus able to engage in both grooves with an interference fit at least in part. Axial displacement between the screw attachment and the socket housing is thus prevented by the substantially radially oriented lateral surfaces of the circlip and of the grooves.

That width is measured in principle in the plug-in direction, that is to say in the direction of the axis of symmetry of the assembled plug connector. The depth of the grooves and the height of the circlip profile are measured in principle at a right angle thereto in the radial direction.

In a preferred embodiment, the profile of the circlip has a height which is greater than its width. This is advantageous in order that, with the desired radial elasticity of the circlip, a sufficiently large radial surface is set against a possible axial displacement, in order thus to hold the screw attachment stably on the socket housing. In particular, the circlip engages in the mounted state in the radial direction into the first groove to the same depth as into the second groove. This position is particularly advantageous since it thus withstands the same force in each groove. In the case of an unsymmetrical distribution, on the other hand, the maximum holding force would be determined by the smaller engagement depth and would therefore be smaller than is the case in the above-mentioned uniform, or at least a more uniform, position. Taking account of manufacturing tolerances, the depth of engagement of the circlip in the assembled state into each groove can be between 40% and 60%, preferably between 45% and 55% and in particular between 47.5% and 52.5%, of the height of the circlip profile in order to utilize the above-mentioned effect particularly advantageously.

Advantageously, the height of the profile of the circlip and the depth of the two grooves are chosen to be sufficient in size that the plug connector is capable of applying a sufficient counterforce to the sum of the expected permanent tensile forces of the cable, vibration forces and occasional or regularly occurring shocks. The screw attachment is thereby held stably on the socket housing even under the action of these forces. The height of the profile of the circlip and the depth of the two grooves can be freely adapted to the particular requirements over a sufficiently large range, without undesirable secondary effects occurring as a result.

Advantageously, the screw attachment has at its end remote from the socket housing a screw thread or at least a so-called "partial thread" for screwing into or onto a mating thread of a mating plug housing. In particular, the screw thread/partial thread is an internal thread and the mating thread is a corresponding external thread. However, in other embodiments, the screw attachment can have an external thread and the mating plug housing can have an internal thread.

The mating plug housing can be an external mounting housing which is mounted, for example, on a wall, for example on the wall of a railway car or of a production site, for example in the vicinity of production machines. The plug connector housing connected thereto is then exposed to a permanent lever action of corresponding cable forces also with simultaneous vibration and regular and/or occasional shocks, which makes particular demands of the stability of the connection. Such demands are made, for example, in the field of the foodstuffs industry, on production lines or also in railway applications, so that a plug connector housing as disclosed be used particularly advantageously in these fields.

In a preferred embodiment, the circlip can be expanded elastically in the radial direction during pre-assembly and pushed over the socket housing with only a small effort. The circlip can subsequently engage into the first groove of the socket housing by relaxing radially inwards and thereby partially engaging into that first groove. In particular, it is advantageous if the first groove is sufficiently deep that the circlip continues to be radially compressible even in this pre-assembled state. The circlip can thus be bent elastically radially inwards during the actual assembly, that is to say when the screw attachment is pushed onto the socket housing. For this purpose, the screw attachment can have a chamfer on the inside at its end facing the socket housing and preferably directly adjacent to the second groove. The circlip can thus penetrate more deeply, in particular fully, into the first groove during the assembly operation as a result of the fitting of the screw attachment. As soon as the screw attachment is finally fitted onto the socket housing and is thus in its final position relative to the socket housing, the circlip can relax radially outwards again in order thus to engage also into the second groove of the screw attachment. The circlip thus penetrates into both grooves in the final mounted state, so that it is arranged with its inner circumference in the first groove and with its outer circumference in the second groove, and holds the screw attachment rotatably on the socket housing.

For this preferred embodiment, it is further particularly advantageous if the depth of the first groove is at least as great as the height of the circlip profile. The circlip can thus be received fully in the first groove during the assembly operation, in particular by elastic compression in the radial direction, in other words can penetrate fully into the first groove, in order thus not to impede the pushing in of the socket housing. On the other hand, however, it is also not desirable, for manufacturing reasons, to make the depth of the first groove greater than is necessary.

Thus, in this preferred embodiment, the depth of the first groove can correspond, within the scope of manufacturing tolerances, to the height of the circlip profile, that is to say, for example, can be between 0.75 times and 1.5 times the height of the circlip profile, in particular between 0.825 times and 1.25 times the height of the circlip profile, preferably between 0.9 times and 1.2 times the height of the circlip profile, and particularly preferably between 0.95 times and 1.1 times the height of the circlip profile.

This preferred embodiment has the additional advantage that the screw attachment can be comparatively small, since the depth of the second groove only has to correspond to the penetration depth of the circlip into that second groove in the assembled state.

In an alternative embodiment thereto, the circlip, in an alternative pre-assembly operation, for example using a special tool, can first be compressed elastically in the radial direction and pushed into the screw attachment and can thus first engage into the second groove of the screw attachment by relaxing and expanding radially and thereby partially engaging into that second groove. In particular, it is advantageous if the second groove has a depth such that the circlip continues to be expandable radially outwards even in this pre-assembled state. Thus, in an alternative assembly operation, that is to say in this case when the socket housing is pushed into the screw attachment, it can first be bent elastically radially outwards by the socket housing and thereby penetrate more deeply, in particular fully, into the second groove. For this purpose, the socket housing can be in conical form on the outside at least at its end facing the screw attachment. As soon as the socket housing has finally been pushed into the screw attachment and is thus in its final position relative to the screw attachment, the circlip can relax radially inwards and thereby also engage into the first groove of the socket housing in order to complete the assembly. The circlip thus penetrates into both grooves in this final assembled state, so that it is arranged with its inner circumference in the first groove and with its outer circumference in the second groove, and holds the screw attachment rotatably on the socket housing.

It is advantageous for this alternative embodiment if the depth of the second groove is at least as great as the height of the circlip profile. The circlip, in the alternative assembly operation, can thus be received fully in the second groove, in particular by elastic expansion in the radial direction, that is to say can penetrate fully into the second groove, in order thus not to impede the pushing in of the socket housing. On the other hand, however, for manufacturing reasons, it is also not desirable to make the depth of the first groove greater than is necessary.

Thus, in this alternative embodiment, the depth of the second groove can correspond, within the scope of manufacturing tolerances, to the height of the circlip profile, that is to say, for example, can be between 0.75 times and 1.5 times the height of the circlip profile, in particular between 0.825 times and 1.25 times the height of the circlip profile, preferably between 0.9 times and 1.2 times the height of the circlip profile, and particularly preferably between 0.95 times and 1.1 times the height of the circlip profile.

This alternative structural form may have the advantage, depending on the more specific manufacturing circumstances, of facilitating the assembly capability of the plug connector housing. Therefore, this variant is preferably suitable, for the above-mentioned reasons, for structural forms in which the screw attachment already has a slightly larger diameter, that is to say does not have to be particularly large solely to allow the second groove to be of a sufficient depth.

A preferred exemplary embodiment is shown in the drawings and is described in greater detail hereinbelow.

DETAILED DESCRIPTION

Figure 1:
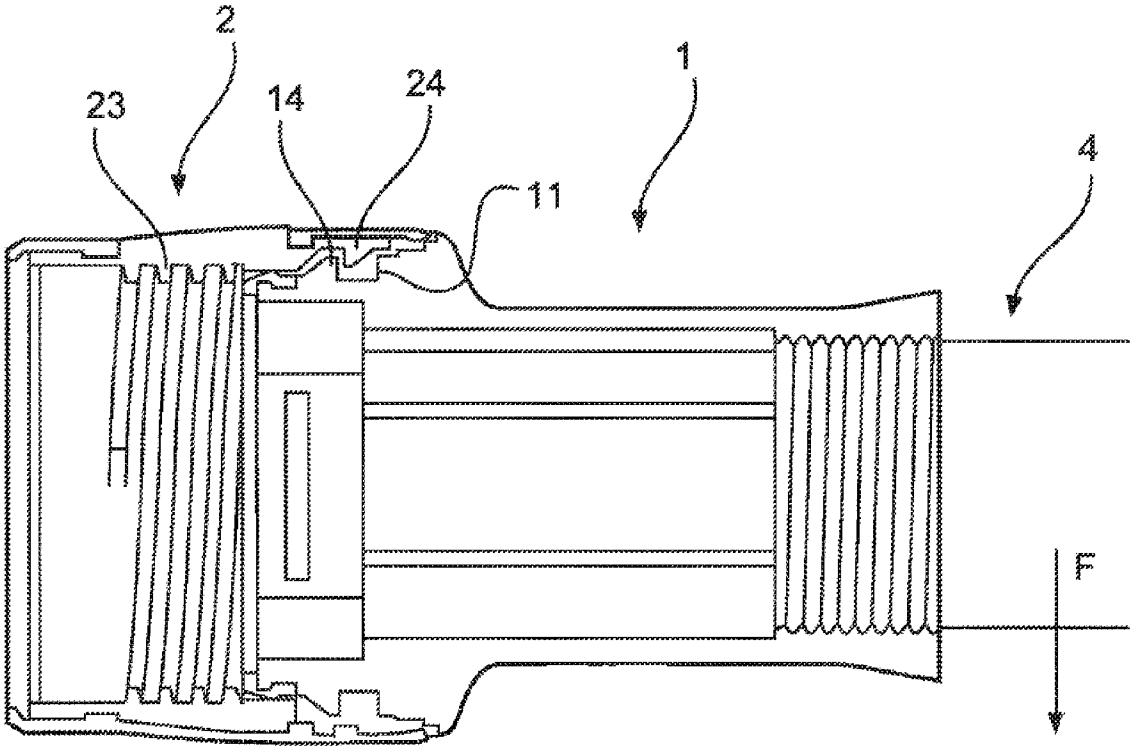
PRIOR ART Fig.1
FIG. 1 shows a plug connector housing corresponding to the prior art in a longitudinal section.

The figures contain in some cases simplified, schematic representations. In some cases, identical reference numerals are used for elements which are the same but may not be identical. Different views of the same elements may be scaled differently.

FIG. 1 shows a plug connector housing corresponding to the prior art in longitudinal section. The plug connector housing has a socket housing 1 and, on the socket side, a screw attachment 3 which has an internal thread 23 and is rotatably fixed to the socket housing. On the opposite side of the socket housing 1, at which a cable is connected, there is shown a cable 4, which in the drawing extends horizontally, the gravitational force of which acts on the plug connector housing in the form of a vertical lever force F.

The socket housing 1 has a circumferential first groove 11, shown here only in profile, into which three locking projections 24 of the screw attachment 2 engage, so that the screw attachment 2 is held rotatably on the socket housing 1. However, of these three locking projections 24, only one locking projection 24 can be seen in the sectional representation because the other two locking projections are formed offset thereto by 120° on the inner circumference, which is of circular cross-section, of the screw attachment 2 and are therefore not visible in this cross-sectional representation. On its side facing the socket housing 1, the locking projection 24 has a sloping surface, not designated in greater detail, which is provided to cooperate with a ramp 14 of the socket housing 1 during assembly. In this manner, the socket housing 1 and/or the screw attachment 2 can correspondingly deform to the necessary extent during the assembly process in order to allow the screw attachment 2 to be pushed onto the socket housing 1 and its locking projections 24 to engage into the first groove 11, so that the screw attachment 2 is held rotatably on the socket housing 1 in the assembled state. However, it will also be appreciated that the shape of the locking projections 24 is largely determined by the requirements of their assembly capability and that in particular their height and thus also the size of their force-accommodating surface facing the mating plug housing is limited. Finally, the elasticity of the socket housing 1 and/or of the screw attachment 2 that is necessary for this type of assembly is extremely disadvantageous for the stability towards any tensile and lever forces which may occur, and therefore greatly limited.

A further disadvantage of this construction is that, for example, strong lever forces F, such as occur as a result of loading with a heavy cable 4, in particular with the additional influence of vibration and shocks, can readily lead to this fixing being undesirably loosened and the plug connection being forcibly separated. Finally, in the case of this geometric arrangement of the locking projections 24, a large part of the load acts, under the most disadvantageous conditions, on a comparatively small contact surface of a single locking projection 24 which is situated at the corresponding geometric position. It is readily apparent from the drawing that the locking projection 24 in question has a contact surface only on its side facing the mating plug housing and on the other side has the mentioned sloping surface for facilitating assembly. Thus, a deformation of the socket housing 1 by lever forces and in particular under the action of vibration and shocks can, depending on the direction thereof, readily lead to the locking projection 24 in question being at least partially pushed and/or shaken out of the first groove 11. This reduces the effective surface available for accommodating forces, and thus makes it even more probable that the locking projection 24 will escape from the first groove 11. This structural form corresponding to the prior art, in particular under corresponding environmental conditions, thus merely represents a compromise between assembly capability and stability during operation, that is to say operational reliability.

Figure 2A:
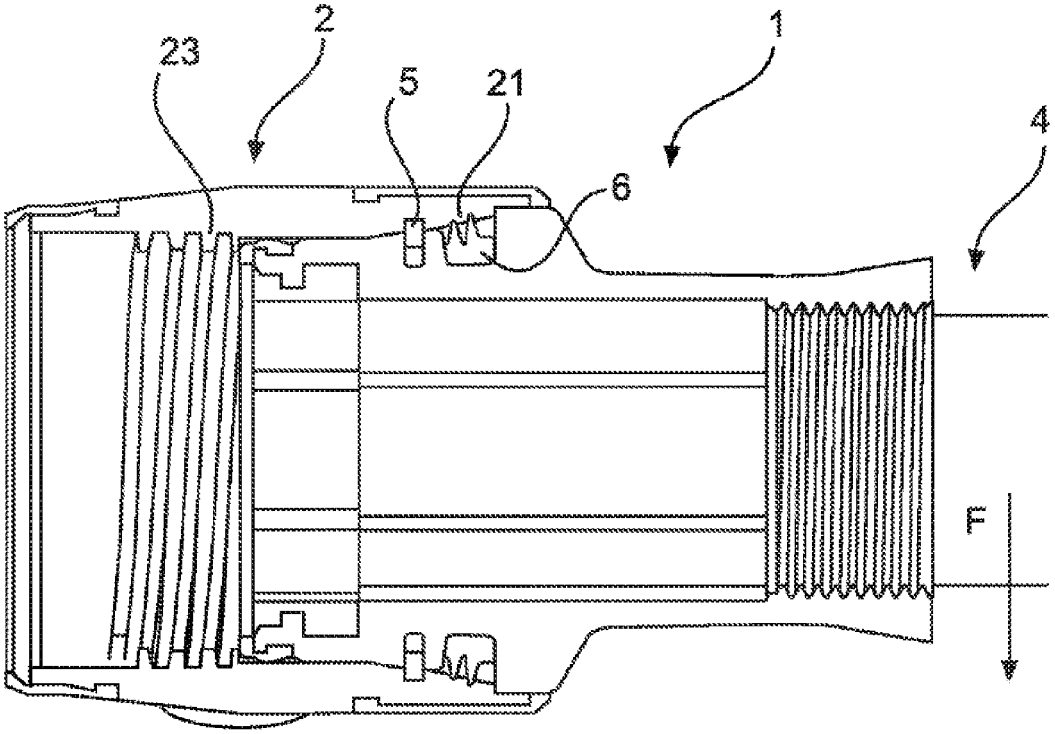
FIG. 2*a* shows a plug connector housing according to the invention in longitudinal section.
Figure 2B:
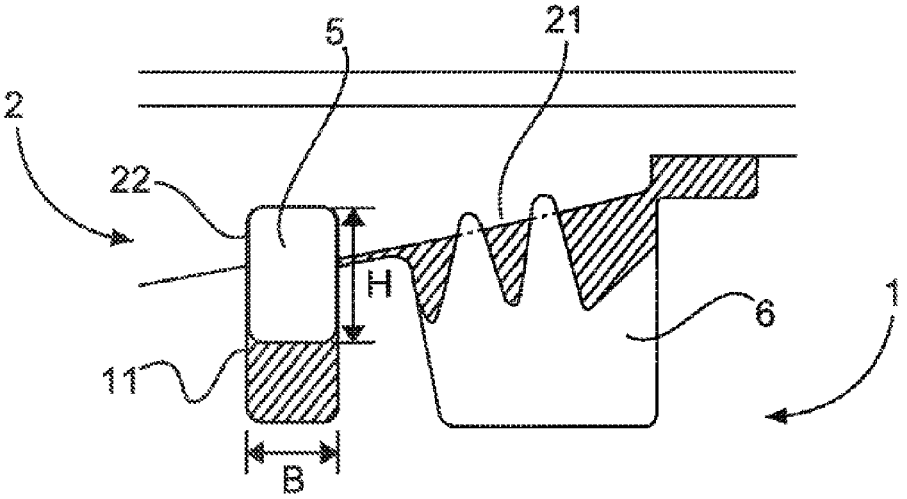
FIG. 2*b* shows an enlargement of the locking mechanism from the preceding representation.
Figure 2C:
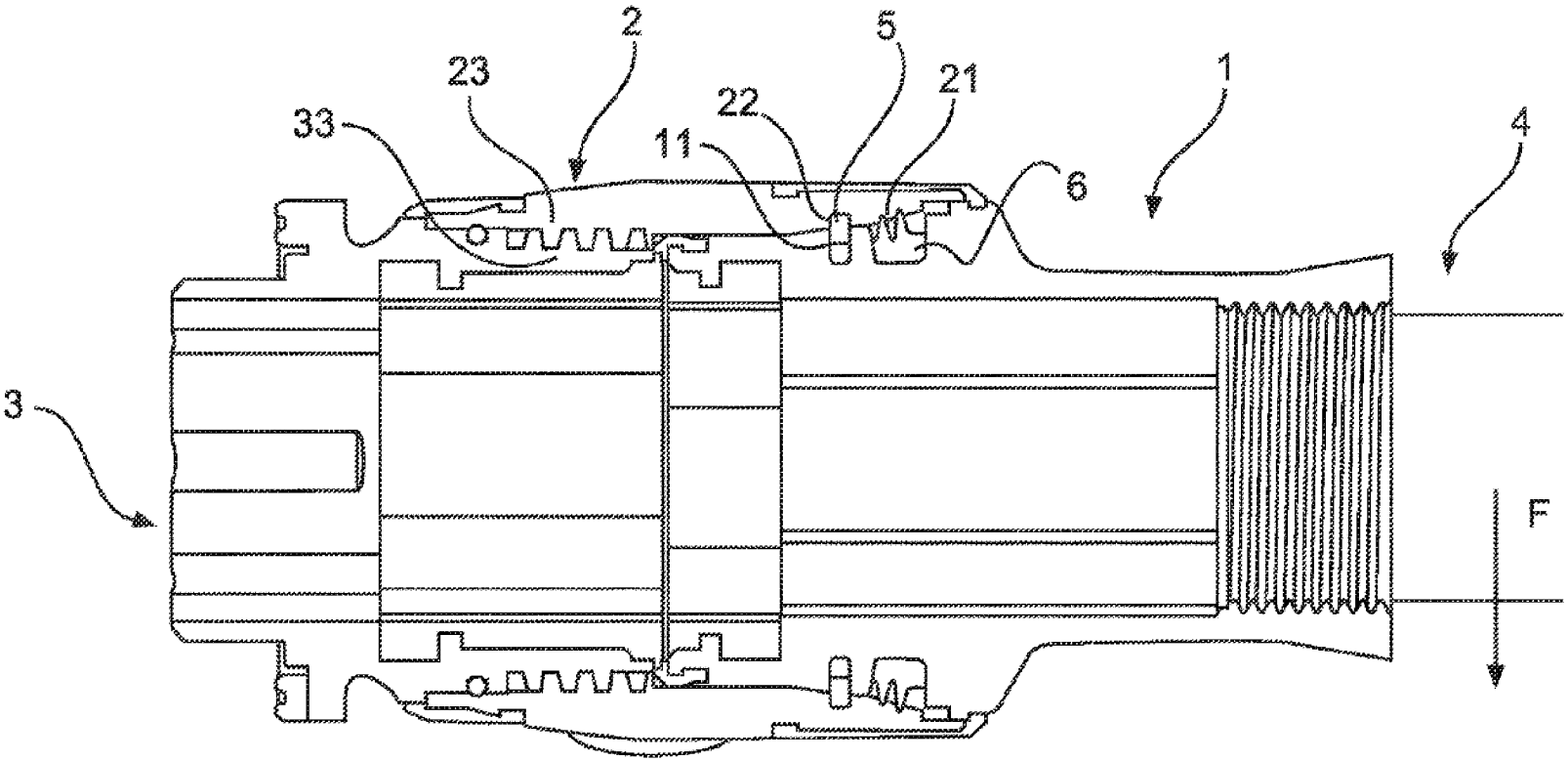
FIG. 2*c* shows the plug connector housing according to the invention with a plug-in region of a mating plug housing in longitudinal section.

FIG. 2*a*, FIG. 2*b* and FIG. 2*c* show a solution according to the invention in different representations, which solution differs from the above prior art on the one hand in that the screw attachment 2 has on its inner circumference of circular cross-section a circumferential second groove 22. On the other hand, an almost completely circumferential circlip 5, which is shown as an individual part in FIG. 5, engages both into the first groove 11 and into the second groove 22. Ideally, the depth of its engagement in the first groove 11 and the second groove 22 is almost equal, whereby the effective force-accommodating surface of the circlip 5 available for accommodating forces is optimized in each direction. In consideration of manufacturing tolerances, the depth of engagement of the circlip 5 into the respective groove is between 40% and 60%, preferably between 45% and 55% and in particular between 47.5% and 52.5%, of the height H of the circlip profile. Furthermore, the screw attachment 2 has a chamfer 21 in the direction of the socket housing 1 for improved assembly, which chamfer in the assembled state additionally also cooperates with a corresponding sealing ring 6.

In order to facilitate assembly, the screw attachment 2 has on an inside at an end facing the socket housing 1 a chamfer 21 by which the circlip 5, being pre-assembled in the first groove 11, during fitting of the screw attachment 2 onto the socket housing 1, is elastically compressed until, in the assembled state, the circlip 5 engages into the second groove 22. The sealing ring 6 is arranged in the socket housing 1 facing the chamfer 21. The sealing ring 6 engages the chamfer 21 in the assembled state with two lips which touch the chamfer 21 axially spaced from one another.

During assembly, as compared with the arrangement shown in FIG. 1, the socket housing 1 no longer needs to be deformed. As a result, the socket housing can be made of a harder material, which is beneficial for the stability of the plug connection. Instead of its, the circlip 5 can perform the corresponding function during assembly and be radially compressed under the action of the chamfer 21 as the screw attachment 2 is pushed onto the socket housing 1, and thus temporarily penetrate more deeply, ideally fully, into the first groove 11. As soon as the screw attachment 2 has been pushed on fully and the two grooves 11, 22 are located above one another, the circlip 5, in order to complete the assembly, engages with its outer region, and thus also with its outer circumference, into the second groove 22 of the screw attachment 2 but remains with its inner region, and thus also with its inner circumference, in the first groove 11. Thus, as compared with the prior art, there is also in each case an almost circumferential and thus significantly enlarged force-accommodating contact surface between the circlip 5 and the respective groove 11, 22, on the one hand as a result of its almost completely circumferential form and on the other hand because the height H of its profile surface can be more than twice the height of the locking projection 24 known from the prior art, the elastic deflection of which is extremely limited for the reasons mentioned above.

FIG. 2*b* shows the relevant mechanism in an enlarged representation. In particular the rectangular profile of the circlip 5, that is to say the rectangular circlip profile, is clearly visible. It will be seen that, although the circlip profile has the same width B as the first groove 11 and the second groove 22, it does not fill the first groove 11 completely in the direction of its height H in the pre-assembled state. The circlip 5 in the arrangement shown here thus continues to be radially compressible.

It will further clearly be seen that the depth of the first groove 11 is at least the height H of the circlip profile. The circlip 5 is thus able to penetrate fully into the first groove 11 during assembly, so that the fitting of the screw attachment 2 to the socket housing is facilitated considerably.

FIG. 2*c* shows a comparable arrangement in which the screw attachment 2 is screwed with its internal thread 23 onto a mating thread 33. This mating thread 33 belongs to the plug-in region 3 of a horizontally oriented mating plug housing, which is in the form of an external mounting housing, not shown fully in the drawing for reasons of clarity, which can be fixed, for example, to a vertical surface, for example a wall.

Figure 3A:
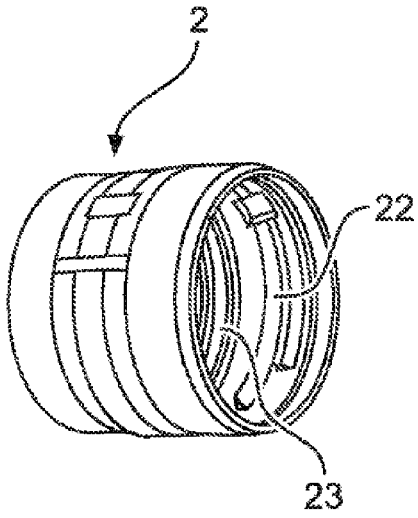
FIG. 3*a* shows a screw attachment in a 3D representation.

FIG. 3*a* shows the screw attachment 2 with the circumferential second groove 22 and the internal thread 23 in a 3D representation.

Figure 3B:
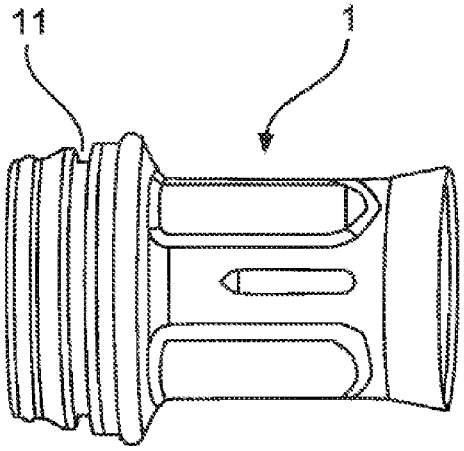
FIG. 3*b* shows a socket housing in a 3D representation.

FIG. 3*b* shows the socket housing 1 with its circumferential first groove 11 in a 3D representation.

Figure 3C:
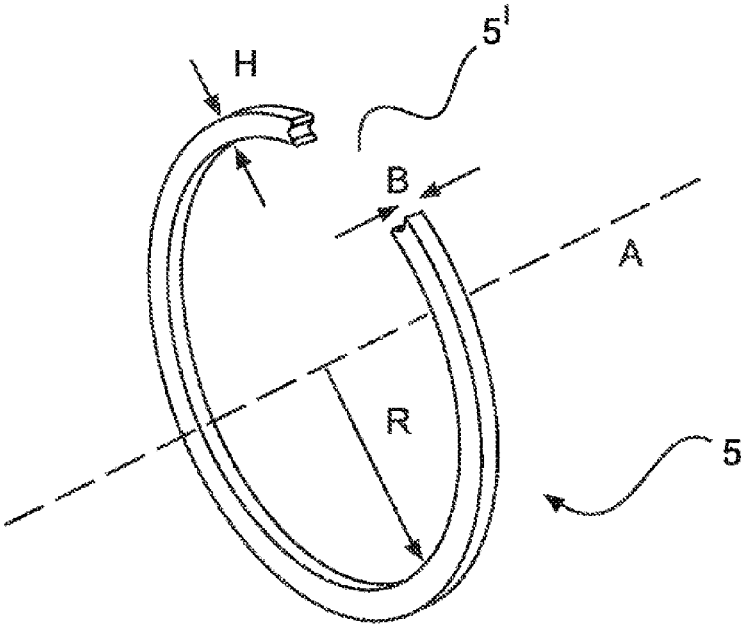
FIG. 3*c* shows a circlip in a 3D representation.

FIG. 3*c* shows the circlip 5. The circlip is open, that is to say is interrupted in one region 5'. In profile, it has a rectangular shape and has a height H and a width B. Its height H is measured in a radial direction, that is to say in the direction of its radius R. Perpendicular to the ring plane runs the axis of symmetry A, which in the assembled state also corresponds to the axis of symmetry of the socket housing 1. The width B of the circlip 5 is measured in the axial direction A, that is to say in the plug-in direction.

In this embodiment, the circlip 5 is made of spring-elastic steel.

LIST OF REFERENCE SIGNS

1 socket housing
11 first groove
14 ramp
2 screw attachment
21 chamfer
22 second groove
23 internal thread
24 locking projection
3 plug-in region of the mating plug housing
33 mating thread of the mating plug housing
4 cable
5 circlip
5' interruption of the circlip
6 sealing ring
F lever force
H height of the profile of the circlip
B width of the profile of the circlip
R radius of the circlip
A axis of symmetry

The invention claimed is:

1. A plug connector, comprising:
a socket housing; and
a screw attachment,
wherein the socket housing has an outer surface of circular cross-section with a circumferential first groove formed therein,
wherein the screw attachment has an inner surface of circular cross-section with a circumferential second groove formed therein, and
wherein the plug connector further comprises a circlip which, in an assembled state, is arranged with an inner circumference of the circlip in the first groove and with an outer circumference of the circlip in the second groove in order to hold the screw attachment rotatably on the socket housing,
wherein, in order to facilitate assembly, the screw attachment has on an inside at an end facing the socket housing a chamfer by which the circlip, being pre-assembled in the first groove, during fitting of the screw attachment onto the socket housing, is elastically compressed until, in the assembled state, the circlip engages into the second groove, and
wherein a sealing ring is arranged in the socket housing facing the chamfer and
wherein the sealing ring engages the chamfer in the assembled state.

2. The plug connector as claimed in claim 1,
wherein the circlip is made of a spring-elastic material, has a circular basic shape, and is open at one point and thus radially deformable.

3. The plug connector as claimed in claim 2
wherein the circlip is both elastically expandable and elastically compressible in the radial direction.

4. The plug connector as claimed in claim 1,
wherein the screw attachment has at its end remote from the socket housing an at least partial internal thread for screwing onto a mating thread or a partial mating thread of a mating plug housing.

5. The plug connector as claimed in claim 1,
wherein the circlip, within a scope of manufacturing tolerances, engages in the radial direction into the first groove to the same depth as into the second groove.

6. The plug connector as claimed in claim 1,
wherein the first groove has a depth, within the scope of manufacturing tolerances, which corresponds at least to a height of the profile of the circlip, so that the circlip can be received fully in the first groove.

7. The plug connector as claimed in claim 1,
wherein both the first groove and the second groove and also the circlip have a rectangular profile.

8. The plug connector as claimed in claim 7, wherein the first groove, the second groove, and the profile of the circlip have the same width.

9. The plug connector as claimed in claim 1, wherein the sealing ring comprises two lips which touch the chamfer axially spaced from one another.

* * * * *